United States Patent [19]

Anton

[11] Patent Number: 4,902,299

[45] Date of Patent: Feb. 20, 1990

[54] NYLON FABRICS WITH CUPRIC SALT AND OXANILIDE FOR IMPROVED DYE-LIGHTFASTNESS

[75] Inventor: Anthony Anton, Wilmington, Del.

[73] Assignee: E. I. Du Pont de Nemours and Company, Wilmington, Del.

[21] Appl. No.: 316,638

[22] Filed: Feb. 28, 1989

[51] Int. Cl.[4] ..... D06P 5/02

[52] U.S. Cl. ..... 8/442; 8/586; 8/624; 8/924; 8/115.58

[58] Field of Search ..... 8/442, 586, 624

[56] References Cited

U.S. PATENT DOCUMENTS 3,770,704 11/1973 Dobinson ..... 524/606
4,253,843 3/1981 Bannigan ..... 8/624
4,544,691 10/1985 Dexter et al. ..... 524/99
4,655,783 4/1987 Reinert et al. ..... 8/115.56
4,655,785 4/1987 Reinert et al. ..... 8/442
4,775,386 10/1988 Reinert et al. ..... 8/442
4,812,139 3/1989 Brodman ..... 8/490
4,874,391 10/1989 Reinert ..... 8/442

*Primary Examiner*—A. Lionel Clingman

[57] ABSTRACT

A surprising improvement in dye-lightfastness of dyed nylon automotive fabrics is achieved by a combination of a copper salt and of an oxanilide light stabilizer. The oxanilide is effective with a surprisingly broad range of copper derivatives. Both the copper and the oxanilide may conveniently be applied from the dyebath, or, surprisingly, the copper provides improvements even if melt-spun into the fiber.

1 Claim, No Drawings

NYLON FABRICS WITH CUPRIC SALT AND OXANILIDE FOR IMPROVED DYE-LIGHTFASTNESS

FIELD OF INVENTION

This invention concerns improvements in and relating to nylon fabrics, such as are used in automotive upholstery, and so have rather stringent requirements for that special purpose, and more particularly to improving their performance in relation to lightfastness, and to the fabrics and their constituent fibers, and process and uses relating hereto.

BACKGROUND OF THE INVENTION

It has been known for at least 4 decades, e.g. from French Pat. No. 906,893, that the degradation (as shown by a deterioration in tensile properties) of polyamides, i.e. nylon fabrics, by exposure to light, has been improved by the addition of copper in the form of cupric compounds, and it has also been known for a long time that their dye-lightfastness has been improved by use of copper compounds. These cupric stabilizers have made it possible to use nylon upholstery fabrics in automobiles, where exposure to heat and sunlight are severe. Other compounds which absorb uv (utraviolet) light have been evaluated in nylon, but none have been found to be as effective as the copper compounds.

As the use of nylon fabrics in automotive upholstery has increased, the range of available shades has multipled, and the automotive industry has become more demanding in its requirements for dye-lightfastness. For instance, a requirement in 1945 that dyed fabrics be able to withstand 80 hours exposure (in a standard test using the carbon arc Weather-Ometer with minimal dye fading) had been increased to 300 hours exposure, by 1978, as the use of selected dyes, improved dyeing procedures, and copper compounds as light stabilizers enabled such advances to be achieved.

It is believed that the automotive industry will require dyed fabrics to withstand 488.8 kilojoules/meter$^2$ (KJ/m$^2$) exposure in the Xenon arc Weather-Ometer (the current preferred exposure method), which corresponds to approximately 600 hours exposure by the carbon arc test, i.e. about double the 1978 standard. This presents a serious problem, as such a high level of dye-lightfastness cannot be achieved with currently available dyes, dyeing technology, and stabilizer technology.

SUMMARY OF THE INVENTION

This problem is solved by the present invention, which provides nylon (i.e. polyamide) yarns and fabrics with improved dye-lightfastness as a result of using a combination of a copper salt, such as was known already, but with, in addition, an oxanilide. The oxanilide is conveniently added to the dyebath, as may be the copper. The oxanilide has been found effective in combination with a surprisingly broad range of copper compounds. Another surprising aspect is that (in combination with the oxanilide) the copper salt can be incorporated by known methods, e.g. into the polymer which is melt-spun into fiber, instead of being added to the dyebath. Accordingly, such method of application is also provided, according to the invention.

DETAILED DESCRIPTION OF THE INVENTION

The nylon fibers according to this invention should desirably contain at least 0.1% by weight of copper and at least 0.5% by weight of the oxanilide (throughout this specification, such amounts are based on the dry weight of the fiber, often in the form of a fabric). Concentrations of copper additive above 1% and oxanilide above 3% have shown little or no further improvement in dye-lightfastness, and higher amounts can introduce other problems, such as color formation, so are not generally desirable.

Suitable copper compounds are known in the art, being those which can be incorporated in the required amount: specific examples are mentioned herein, and in the references, and include the soluble copper salts of inorganic acids, such as copper sulfate; a colloidal dispersion of cupric phosphate (described in U.S. Pat. No. 4,253,843) sold by Crompton & Knowles as Intralan Salt 44; soluble copper salts of organic acids, such as cupric acetate; and effective organic copper complex compounds, including a cupric disalicylidene complex (described in U.S. Pat. No. 4,655,783) sold by Ciba Geigy as Cibafast N. EPA 245,204 and EPA 255,481 recommend the use of such copper complex as a preferred dye-bath additive, because it goes on the nylon like a dye, and that it be used with a wide variety of light protecting agents, and list benzotriazole and numerous other uv absorbers (but do not mention oxanilides). However, it should be noted that a surprisingly wide range of copper compounds (not merely these complexes) may be used in combination with oxanilides, in accordance with the present invention.

The copper compound can be added to the nylon polymer and melt-spun, as described, e.g., in Stamatoff U.S. Pat. No. 2,630,421, directed to the use of halides in combination with copper compounds. It is surprising that this method of providing copper is effective, in combination with oxanilides, in view of the water-solubility of many copper derivatives. The copper compound can also be added to the dyebath along with the oxanilide, or separately.

The term polyamide (or nylon) herein includes such polymers of poly(hexamethylene adipamide) (66), polycaproamide (6), poly(hexamethylene dodecamide) (612), and polyamide copolymers. The invention will be illustrated more specifically herein with 66 nylon, being most readily available.

As mentioned above, the invention is directed to stabilization by use of copper in conjunction with a specific type of ultraviolet light absorber, namely an oxanilide. Sanduvor VSU Liquid, sold by Sandoz AG, has proved especially effective, according to the invention, and is used herein to demonstrate the effectiveness of the invention.

The comparative tests herein were performed as follows:

Nylon fabrics were scoured and dyed, similarly, except in different dyebaths containing (as indicated in each Example) the individual light-stabilizing agents along, and in combination (according to the invention), and a control sample was dyed without the use of either stabilizer (referred to as "none" in the Examples). When the filaments were melt-spun from polymer containing the copper compound, (e.g. in Example 2), a comparison was made between a dyebath containing no additive and one containing the oxanilide. These dyed samples were dried, exposed to the Xenon arc, and evaluated for lightfastness with the aid of a reflectometer.

Three different color combinations that are sensitive to light were used, their names and compositions being given in Table 1, and commercially available sources being described in the Buyer's Guide of the American Association of Textile Chemists and Colorists.

TABLE 1

| Color | Dyes | Composition (%) |
|---|---|---|
| Cobalt Blue | Avilon Scarlet 2R (200) | 0.05 |
| | Irganol B Blue 7GS (200) | 0.39 |
| | Avilon Blue RW | 0.19 |
| | Irgalon Black RBL (200) | 0.12 |
| Light Driftwood | Irgalon Yellow GRL (200) | 0.040 |
| | Avilon Scarlet 2R (200) | 0.009 |
| | Irgalon Blue 3GL (200) | 0.008 |
| | Irgalon Black GBL (200) | 0.0065 |
| Medium Dark Gray | Irgalon Yellow GRL (200) | 0.041 |
| | Avilon Scarlet 2R (200) | 0.026 |
| | Irgalon Blue 3GL (200) | 0.120 |
| | Irgalon Black GBL (200) | 0.078 |

DYEING PROCEDURE

These procedures were carried out in a Launderometer, using a bath to fabric volume ratio of 40 to 1.

Prescour

A prescour bath containing 1.0% by weight of Duponol RA (a fortified sodium etheralcohol sulfate from Du Pont) and 0.5% by weight of tetrasodium pyrophosphate is heated to 80° F. (32° C.). Fabrics are added and the temperature of the bath is raised to 180° F. (88° C.), at a rate of 3° F./min. (1.7° C./min), held at that temperature for 20 minutes, then dropped, and the fabrics are then rinsed thoroughly.

Dyeing

A bath containing 0.5% Irgasol SW (an aliphatic nitrogenous ethylene oxide condensate from Ciba Geigy), 0.5% ammonia, and 3.0% ammonium acetate is heated to 80° F. (32° C.). Where appropriate, the copper compound and/or the oxanilide are added. In any event the pH is checked and adjusted to 7.5-8 with ammonia. Test fabrics are added and the bath temperature held unchanged for 5 minutes. The appropriate dyes are added and the temperature held unchanged for 15 minutes. The temperature is then raised to 212° F. (100° C.) at the rate of 1° F./min. (0.6° C./min.) and kept at the boil for 45 minutes. The bath is cooled at 140° F. (78° C.) and dumped. The fabrics are rinsed, excess water is removed, and the fabrics are allowed to dry.

Lightfastness Evaluation

Dried fabrics are cut into approximately 2.5" squares, which are mounted on 2.5"×8" cards (usually two to a card) and placed in a Model C. 135W Xenon arc Weather-Ometer, which is available from Atlas Electric Devices Co., 4114 N. Ravenswood Ave., Chicago, IL 60613. The samples are exposed to various amounts of radiation, using a light source with a wavelength of 340 nm. 225 KJ/m$^2$ of radiation is about equivalent to 300 hours exposure in the twin-carbon arc Weather-Ometer used in some earlier work.

The reflectances of the unexposed (control) sample and exposed samples are meaured with Macbeth 1500+Reflectometer at daylight 6500 Kelvin illumination and an observer angle of 10 degrees. The difference between the control and exposed samples are calculated as DE values from the equation:

$$DE = \sqrt{(DL^*)^2 + (Da^*)^2 + (Db^*)^2}$$

where L* defines the depth of color, "a*" is the amount of red-green, and "b*" is the amount of blue-yellow in the color. The Reflectometer measures each of these values and feeds the results into a computer, which calculates DE. The smaller the DE value the less the effect of the light exposure on the fabric.

More details about this measurement can be found in ASTM Standards on Color and Appearance Measurements, ASTM (1984) Philadelphia, PA. Another reference is "Colour Physics for Industry," edited by Roderick McDonald (1987), Society of Dyers and Colourists, West Yorkshire, England.

%T (PERCENTAGE OF YARN TENACITY RETAINED)

This comparison is carried out on knitted tubing fabrics, some of which are exposed to radiation, as described herein. Exposed and unexposed yarns are deknitted from the knitted tubings, their tenacities measured on an Instron, and the percentage tenacity of an unexposed yarn that is retained after exposure to radiation is calculated for each.

The invention is illustrated by the following Examples. In these Examples, the percentage of additive reported is based on the dry weight of the fabrics in the bath.

EXAMPLE 1

A velour fabric is woven with a 2/30 worsted count pile yarn, which has been spun from 3 dpf nylon 66 staple. Samples approximately 2.5" square are cut from the fabric and dyed in accordance with the procedure which has been described. In this Example, the cupric salt was Intralan Salt 44 and was used in samples 2 and 5 at a percentage weight of 1% (referred to in the Table as "Cu-1%"), and the oxanilide was Sanduvor VSU and was used in sample 3 at a percentage weight of 1%, and in samples 4 and 5 at a percentage weight of 3% (referred to, respectively, as "ox-1%" and "ox-3%"). The squares are dried, exposed in the Xenon arc Weather-Ometer, and their DE values are determined. The data are reported in Table 2.

TABLE 2

| Color | Dye Bath Additive | DE Values 225 | 488 | 800 |
|---|---|---|---|---|
| Md. Dk. Gray | 1-None | 12.1 | 31.9 | 41.1 |
| | 2-Cu-1% | 7.5 | 16.8 | 26.6 |
| | 3-ox-1% | 7.2 | 16.4 | 27.0 |
| | 4-ox-3% | 7.5 | 8.8 | 21.1 |
| | 5-Cu-1%/ox-3% | 4.2 | 8.7 | 18.6 |
| Lt. Driftwood | 1-None | 15.3 | 25.0 | 29.0 |
| | 2-Cu-1% | 10.8 | 21.3 | 25.9 |
| | 3-ox-1% | 10.1 | 19.7 | 24.7 |
| | 4-ox-3% | 7.9 | 15.5 | 17.5 |
| | 5-Cu-1%/ox-3% | 5.6 | 9.7 | 11.3 |
| Cobalt Blue | 1-None | 8.4 | 25.8 | 37.7 |
| | 2-Cu-1% | 4.3 | 15.0 | 28.0 |
| | 3-ox-1% | 5.9 | 18.9 | 29.8 |
| | 4-ox-3% | 6.4 | 17.9 | 27.2 |
| | 5-Cu-1%/ox-3% | 3.4 | 7.9 | 12.0 |

Many shades of blue are especially light sensitive, so that improvement obtained in this Example with Cobalt Blue is especially significant.

EXAMPLE 2

Nylon 66 polymer containing 0.02% of cupric acetate, 0.05% of potassium iodide and 0.010% of potassium bromide, all by weight, were melt spun to filaments of 3 denier. The filaments were crimped and cut to staple, which was spun to provide a 20/2 cotton count yarn, that contained 100ppm of copper. Knit tubing were knitted with these yarns, and the tubings dyed with Cobalt Blue by the procedure described, with and without Sanduvor VSU as a dyebath additive. The dried dyed tubings were exposed in the Xenon arc Weather-ometer to the amounts of radiation indicated, and DE values and % tenacity retained were determined and are reported in Table 3.

TABLE 3

| Dye Bath Additive | KJ/m2 | DE | % T |
|---|---|---|---|
| None | 225 | 8.2 | 69 |
| | 500 | 16.5 | 33 |
| 3% Sanduvor VSU | 225 | 5.7 | 87 |
| | 500 | 13.1 | 45 |

These results show that an oxanilide/copper salt combination is effective in improving light stability when the copper is incorporated in the polymer prior to melt-spinning.

EXAMPLE 3

20/2 cotton count yarns were spun from 3 dpf nylon 66 staple which, as in Example 1, did not contain cupric acetate, potassium iodide or potassium bromide. Knit tubings prepared from these yarns were dyed with Cobalt Blue, with and without additives, as indicated, were exposed to Xenon arc radiation, and data were obtained, as in Example 2, and are reported in Table 4.

TABLE 4

| Dye Bath Additive | KJ/m2 | DE | % T |
|---|---|---|---|
| None | 225 | 12.8 | 22 |
| | 300 | 16.6 | 14 |
| | 500 | 24.0 | 5 |
| Cu-0.5% | 225 | 8.2 | 71 |
| | 300 | 10.1 | 61 |
| | 500 | 13.7 | 43 |
| ox-3% | 225 | 9.2 | 44 |
| | 300 | 13.1 | 26 |
| | 500 | 20.0 | 7 |
| Cu-0.5%/ox-3% | 225 | 5.3 | 90 |
| | 300 | 6.9 | 70 |
| | 500 | 10.8 | 42 |

These results again show the superior dye-lightfastness obtained by using a combination of copper salt and oxanilide over either additive used separately.

EXAMPLE 4

Knit tubings spun from nylon yarns (without copper) were again dyed with Cobalt Blue, with and without additives, as indicated, and dye-lightfastness data after exposure to 500 KJ/m$^2$ radiation were obtained and are reported in Table 5.

TABLE 5

| Dye Bath Additive, %, Dry Wt. Fabric | | | |
|---|---|---|---|
| Sanduvor VSU | Intralan Salt 44 | Cibafast N | DE |
| 0 | 0 | 0 | 22.8 |
| 2.0 | 0 | 0 | 17.0 |
| 0 | 0.5 | 0 | 13.2 |
| 1.0 | 0.5 | 0 | 10.3 |
| 2.0 | 0.5 | 0 | 9.9 |
| 3.0 | 0.5 | 0 | 9.7 |
| 2.0 | 1.0 | 0 | 8.9 |
| 2.0 | 0.25 | 0 | 8.5 |
| 0 | 0 | 0.5 | 12.5 |
| 2.0 | 0 | 0.5 | 7.6 |

EXAMPLE 5

This Example shows that similarly good results are obtained when Intralan Salt 44 is replaced by cupric sulfate in the dyebath. The tests were run on nylon 66 velour fabric samples dyed with Cobalt Blue, and the results are reported in Table 6.

TABLE 6

| Dye Bath Additive | KJ/m2 | DE |
|---|---|---|
| None | 225 | 7.26 |
| | 325 | 17.49 |
| | 500 | 22.05 |
| 0.1% Cupric Sulfate | 225 | 4.47 |
| | 325 | 7.52 |
| | 500 | 9.42 |
| 2.0% Sanduvor VSU | 225 | 9.72 |
| | 325 | 12.61 |
| | 500 | 17.91 |
| 0.1% Cupric Sulfate | 225 | 2.24 |
| +2.0% Sanduvor VSU | 325 | 2.40 |
| | 500 | 2.91 |

The Examples show significantly superior dye-lightfastness was obtained by the use of a combination of copper salts and oxanilide, even after exposure to 500 KJ/m$^2$ of radiation, and, in the case of Example 1, after 800 KJ/m$^2$.

I claim:

1. An improved dyed nylon fabric that is suitable for use in automotive upholstery, and is provided with dye-lightfastness by the presence of a cupric salt, the improvement being characterized by the presence of oxanilide, in addition to the cupric salt.

* * * * *